US006568720B1

(12) United States Patent
Szablewski

(10) Patent No.: US 6,568,720 B1
(45) Date of Patent: May 27, 2003

(54) DOOR LOCK WITH ROLLER CATCH, ESPECIALLY FOR MOTOR VEHICLES

(75) Inventor: Piotr Szablewski, Wuppertal (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/646,857

(22) PCT Filed: Mar. 15, 1999

(86) PCT No.: PCT/EP99/01686

§ 371 (c)(1),
(2), (4) Date: Sep. 22, 2000

(87) PCT Pub. No.: WO99/49159

PCT Pub. Date: Sep. 30, 1999

(30) Foreign Application Priority Data

Mar. 23, 1998 (DE) ..... 198 12 606

(51) Int. Cl.[7] ..... E05C 3/06
(52) U.S. Cl. ..... 292/201; 292/216; 292/DIG. 23
(58) Field of Search ..... 292/201, 216, 292/DIG. 23

(56) References Cited

U.S. PATENT DOCUMENTS 4,762,348 A * 8/1988 Matsumoto ..... 292/201
5,639,130 A * 6/1997 Rogers et al. ..... 292/199
5,678,869 A * 10/1997 Yoshikuwa ..... 292/216
5,938,252 A * 8/1999 Uemura et al. ..... 292/201
6,112,564 A * 9/2000 Rathmann et al. ..... 292/201
6,116,664 A * 9/2000 Wegner ..... 292/201
6,279,361 B1 * 8/2001 Baukholt et al. ..... 292/201
6,505,867 B1 * 1/2003 Szablewski et al. ..... 292/201

FOREIGN PATENT DOCUMENTS

| | | |
|---|---|---|
| DE | 195 33 196 A1 | 3/1997 |
| EP | 0109656 | 5/1984 |
| EP | 0133508 | 2/1985 |

* cited by examiner

*Primary Examiner*—Anthony Knight
*Assistant Examiner*—John B. Walsh
(74) *Attorney, Agent, or Firm*—Friedrich Kueffner

(57) ABSTRACT

The invention relates to a door lock provided with a roller catch (11). When the door is closed an immobile locking part (10) moves into said roller catch (11), causing it to pivot from an open position into a preliminary or main latching position, the roller catch (11) being held by a latch. For greater user comfort and a more compact door lock the invention provides for the same drive motor (30) to be used as locking aid and as opening aid. A transmission element (35) which can be moved into two different positions is introduced into the gear assembly (31, 37). The drive energy generated by the drive motor (30) is transmitted in one position to the roller catch and in the other position to a second output track leading to the locking latch (20).

19 Claims, 13 Drawing Sheets

| Table for 50 | | |
|---|---|---|
| Position of Door | Sensor 51 | Sensor 52 |
| Open Position | 0 | 0 |
| Pre-catch Position | 1 | 1 |
| Main Catch Position | 0 | 1 |

FIG. 8a

| Table for 50 | | |
|---|---|---|
| Position of Door | Sensor 51 | Sensor 52 |
| Open Position | 0 | 1 |
| Pre-catch Position | 1 | 0 |
| Main Catch Position | 0 | 0 |

FIG. 8b

| Table for 50 | | |
|---|---|---|
| Position of Door | Sensor 51 | Sensor 52 |
| Open Position | 0 | 0 |
| Pre-catch Position | 0 | 1 |
| Main Catch Position | 1 | 1 |

FIG. 8c

| Table for 50 | | |
|---|---|---|
| Position of Door | Sensor 51 | Sensor 52 |
| Open Position | 0 | 1 |
| Pre-catch Position | 0 | 0 |
| Main Catch Position | 1 | 0 |

FIG. 8d

DOOR LOCK WITH ROLLER CATCH, ESPECIALLY FOR MOTOR VEHICLES

BACKGROUND OF THE INVENTION

1. Field of the Invention

The invention relates to a door lock wherein the roller catch comprises in addition to the pre-catch also a main catch into which the pawl drops. Sometimes a gap remains when closing an open door because the pawl reaches only the pre-catch of the roller catch. This means that the roller catch remains in its pre-catch position. In order to be.able to close the gap, the auxiliary motor means are provided which engage the roller catch. They have the task to further move the roller catch into its final position in which the pawl drops into the main catch. In the following, this final position will be referred to as "main catch position". The door gap is now closed.

2. Description of the Related Art

In a known door lock (DE 195 33 196 A1) two drive motors cooperate via two gears with a pivotable carousel support on which the pawl is positioned. One motor serves as a closing aid and the other motor as an opening aid. During closing, the pawl is pushed away by a pre-catch interruption lever until, by means of the locking part being inserted, the roller catch has reached its final main catch position relative to the pawl and the pawl drops into the main catch of the roller catch. Only thereafter, the drive motor is started and pivots the carousel support with the pawl so that the pawl rotates the roller catch past the main catch position into its rotational end position. In this case, a pawl that is entrained by the gear is provided, and the roller catch, after the pawl has dropped into its main catch, is still moved farther. An interruption of the drive motor is not provided and thus also does not result in a release of the transmission chain between the motor and the roller catch.

The known door lock requires a lot of space. During closing of the aforementioned door gap disruptions may result, for example, by an obstacle which projects into the door gap. Then it is required that any further movement of the roller catch is immediately interrupted and the pressure of the gear acting on the door is cancelled.

SUMMARY OF THE INVENTION

It is an object of the invention to develop a reliable door lock of the kind mentioned in the preamble of claim 1 which, on the one hand, improves the operating comfort but, on the other hand, is of a space-saving configuration. This is achieved according to the invention by one and the same drive motor being used for the closing aid as well as for the opening aid, by a transmission member being arranged in the gear and switchable between two switching positions, by the drive energy exerted by the drive motor reaching the transmission member but, as a function of the switching position of the transmission member, reaching alternatively behind the transmission member the roller catch or the locking pawl via one of two separate drive paths, wherein one drive path belongs to the closing aid and the other belongs to the opening aid.

According to the invention, one and the same drive motor can be used for the closing aid as well as for the opening aid. It is sufficient in this context to arrange in the gear a transmission member which can be controlled to alternate between two switching positions. The drive energy provided by the drive motor is transmitted on a common path to the transmission member. Behind the transmission member, however, the drive energy is alternatively guided on one of two separate drive paths. One drive paths belongs to the closing aid and the other to the opening aid. It depends only on the switching position of the transmission member onto which one of the two drive paths the drive energy is directed. Accordingly, the apparatus expenditure is substantially reduced.

For reversing the transmission member, it is recommended that the transmission member is secured by a spring force normally in that switching position in which the drive energy exerted by the drive motor is not transmitted to the roller catch, that the transmission member is connected with a switching device which, at a defined limit angle of the roller catch and/or of the pawl, is activated and transfers the transmission member into its other switching position wherein the drive energy exerted by the drive motor acts on the roller catch in the pulling shut direction, and that the switching device is deactivated in a disturbance situation during the pulling shut phase as well as in the main catch position and, by doing so, the transmission member is automatically returned by the spring force again into its switched off position. Usually, the transmission member is secured by a spring force in that switching position in which the drive energy of the drive motor does not reach the roller catch. This normal situation is also present in the open position of the roller catch up to a certain limit angle position of the roller catch as well as in the final main catch position. This limit angle position may be, for example, the pre-catch position of the roller catch. Only when the limit angle position of the roller catch during closing of the door has been reached, a switching device is activated which reverses the transmission member. This switching device engages the transmission member and transfers the transmission member into its other position where the drive energy of the drive motor acts on the roller catch and can pull it shut.

In the case of disruption, only the control impulse acting on the switching device must be turned off. Subsequently, the pulling shut phase is simply interrupted in that the switching device releases the transmission member and the latter is returned into its other switching position because of the spring force. Since the remaining gear portion connected to the roller catch is released, the roller catch is no longer arrested and the pressure acting on the door is relieved. Even the effect of the elastic door seals can result in a return movement of the roller catch. After switching of the transmission member has occurred in the pulling shut phase, it may be possible that the drive motor that has been set in motion as well as the drive members, positioned in front of and moved by the transmission member, will move still according to the principle of inertia, but the movement energy of these masses is no longer transmitted onto the roller catch. The roller catch is immediately set still, respectively, it can even rotate in the opposite direction.

Of independent inventive importance is the third embodiment according to which, for determining the respective position of the door, control means are provided which comprise two sensors and a control logic connected to the sensors, wherein one sensor responds to a certain angle position of the roller catch, or a certain position of the locking part of the door post supporting the locking part relative to the lock of the door, respectively, and, subsequently, will be referred to as roller catch sensor, while the other sensor responds to the drop of the pawl into the pre-catch as well as into the main catch of the roller catch and is therefore referred to as pawl sensor, and wherein the control logic evaluates commonly the individual signals coming from the two sensors and the different alternatives described in connection therewith. This door lock can also be used independent of a pulling shut aid and/or an opening aid. However, in individual situations the use in connection with a door lock according to the above described first and second embodiments is possible and will also be explained in the following description in more detail. The door lock according to the third embodiment concerns the following problem.

It is important to determine the respective position of the door unequivocally in order to, according to this determination, initiate further functions of the vehicle or to control them, for example, the interior illumination of the vehicle. For this purpose, sensors are used. In the past it was required to position the sensors within very tight tolerances for an exact position determination of the door. Moreover, the use of correspondingly exactly operating sensors was required. Finally, the high sensitivity of the sensors should not change during their service life. The manufacture of sensors with such high requirements is difficult and expensive. Moreover, the known sensors had to be exactly mounted which is cost-intensive. The invention avoids these disadvantages by special control means. In this connection the following effects result.

Because of the common evaluation of the individual signals of the two sensors, an exact positioning of these sensors with respect to the roller catch or with respect to the pawl is initially not required. Mounting of the sensors is therefore facilitated, faster, and can be performed less expensively. Moreover, the invention makes it possible to even use relatively imprecisely operating sensors because the summation evaluation of the signals allows to determine the respective door position very precisely. According to the invention it is also of no consequence when the sensitivity of the two sensors decreases over the course of time. In this case the summation-based control logic can determine very precisely the point in time.

BRIEF DESCRIPTION OF THE DRAWINGS

Further measures and advantages of the invention result from the claims, the following description, and the drawings. In the drawings, the invention is illustrated in several embodiments. It is shown in:

FIGS. 3*a*–3*c* the corresponding plan and side views in that movement phase of the door where the roller catch has been moved motorically by a closing aid according to the invention just into its main catch position and the closing aid is still switched on;

FIGS. 8*a*–8*d* four alternative tables for the effectiveness of a control logic, correlated with the control means of FIGS. 6*a* to 6*c* and 7*a* to 7*c*, for detecting the respective door position.

DESCRIPTION OF PREFERRED EMBODIMENTS

Figure 1A:
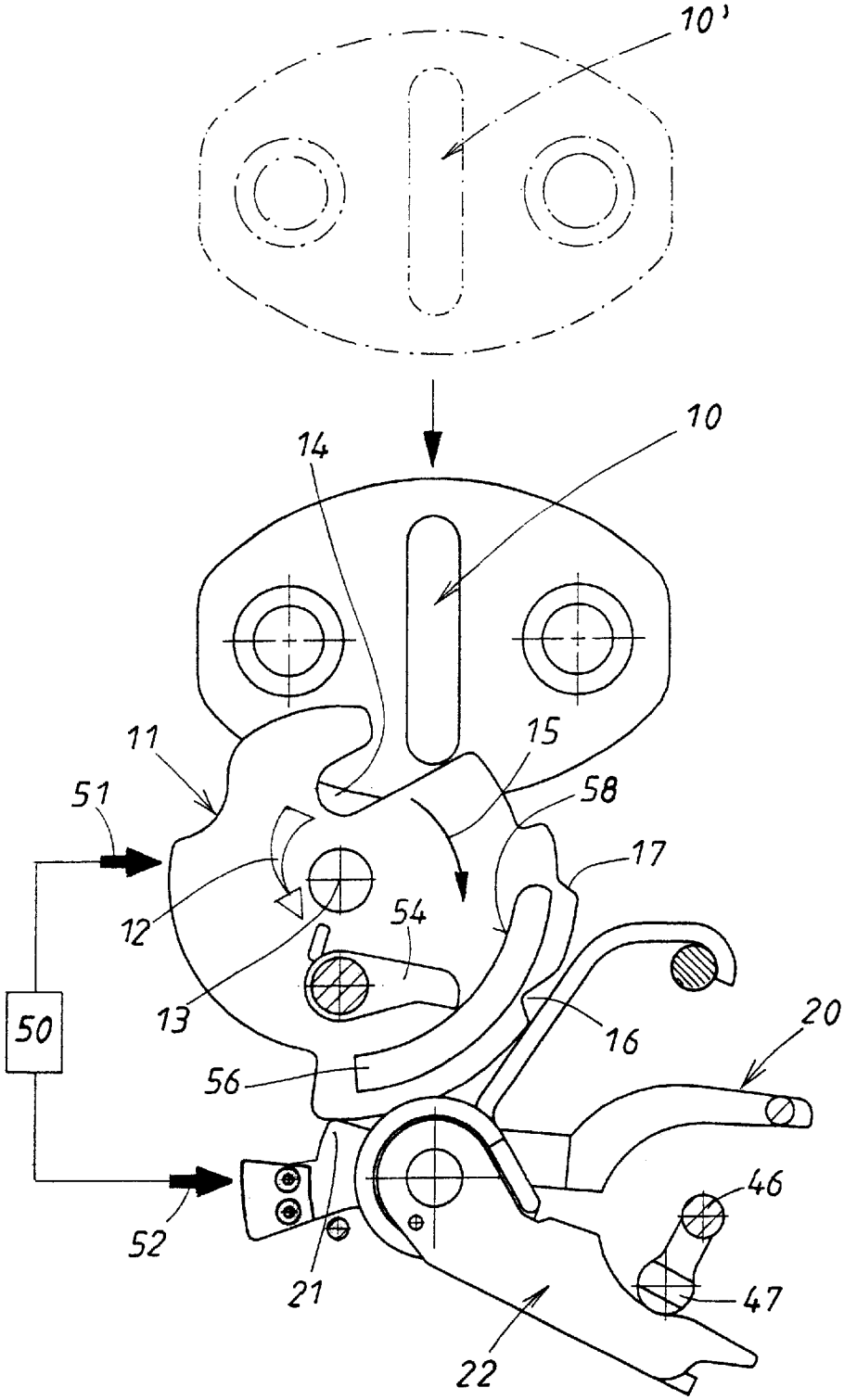
FIG. 1*a* a plan view of the lower part of the inventive lock in the viewing direction of section line Ia—Ia of FIG. 1*c*, when the roller catch is still in its open position but the door is on its way to being closed.

The configuration of the lock is explained in more detail with the aid of FIGS. 1*a* to 1*d*. The door lock comprises a roller catch 11 which is subjected to a restoring force, illustrated by the force arrow 12, of a spring, not shown in detail. The roller catch 11 is pivotably supported on a bearing pin 15 in a housing, not shown in detail, and is usually fastened on the door, not shown in detail. Instead of a side door, another type of door, for example, the rear hatch of a motor vehicle, could be concerned. The roller catch 11 comprises a slot-shaped receiving device 14 for a locking part 10 which is bracket-shaped in this embodiment. When the locking part is removed from the roller catch 11, as illustrated at 10' in FIG. 1*a*, it is maintained by its spring-load 12 and rotary stops, not illustrated in detail, in an open position illustrated in FIG. 1*a*. In this connection, the roller catch 11 with its receiving device 14 remains accessible from the exterior. The locking part 10 is usually fastened on the door post. The arrangement of the locking part 10, however, can also be on the door, wherein the roller catch 11 is then stationarily positioned with its housing on the post. Based on the release position 10' of FIG. 1*a* illustrated in a dash-dotted line, the locking part 10 moves into the receiving device 14, when the door is closed, and pivots thus the roller catch 11, against its return force 12, in the direction of the pivot arrow 15, from the open position illustrated in FIG. 1*a* into the pre-catch position illustrated in FIG. 2*a*. The roller catch 11 comprises at least two catches 16, 17, i.e., a pre-catch 16 and a main catch 17. A pawl 20 engages the catches 16, 17 with its locking arm 21 when the roller catch 11 is in its already mentioned pre-catch position of FIG. 2*a* or in a final main catch position illustrated in FIG. 3*a*.

Figure 2A:
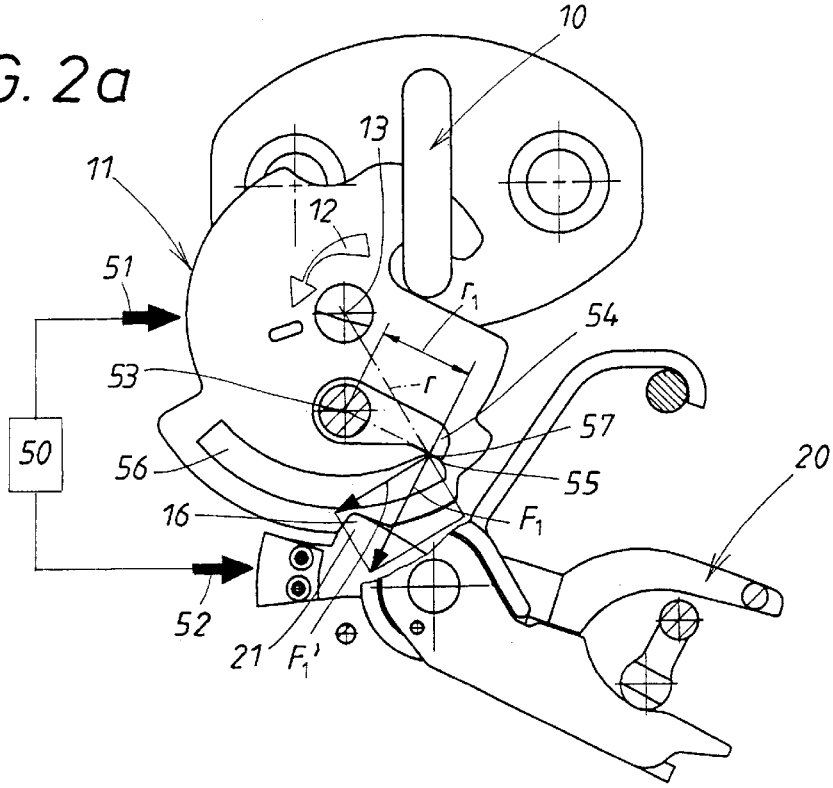
FIGS. 2*a*–2*c* plan and side views of the lock, in analogy to FIGS. 1*a* to 1*c*, in a subsequent phase of the closing movement of the door when the locking part entrains the roller catch and has moved it into its pre-catch position.

When the pre-catch position of FIG. 2*a* has been reached, usually a gap remains between the door and the door post. The invention is now provided with a motor-driven closing aid. It is embodied in a special way and engages the roller catch. In the pre-catch position of FIG. 2*a* the closing part 10 is already engaged by the roller catch. There is already a positive locking connection between 10, 11.

As illustrated by arrows 51, 52 in FIG. 2*a*, at least two sensors 51, 52 are provided wherein one of them (51) becomes active when the roller catch 11 is in the pre-catch position illustrated in FIG. 2. The other sensor 52 is activated when the pawl 20 has reached its pivot position illustrated in FIGS. 2*a* and 3*a*, wherein the locking arm 21 engages either the pre-catch 16 or the main catch 17. The sensors 51, 52, when activated, send a signal to a schematically illustrated control logic 50. The signals are evaluated therein, and for each situation the corresponding activities of the lock are activated which will be explained in more detail in the following. This can be explained more specifically with the aid of the table of FIG. 8*a*.

The control logic 50 detects the open position of the roller catch 11 of FIG. 1*a* when, according to the table of FIG. 8*a*, first line, both sensors 51, 52 do not release the signal. This holds true also for the initial rotational path of the roller catch 11 into the position illustrated in FIG. 2*a*. However, when the pre-catch position of FIG. 2*a* has been reached, both sensors 51, 52, according to the second column of table of FIG. 8*a*, will send a signal. Thus, the control logic 50 will recognize unequivocally that the pre-catch position of FIG. 2*a* has been reached. In the final main catch position of FIG. 3*a* only the second sensor 52 will send a signal but not the first sensor 51, as can be seen in the last line of the table of FIG. 8*a*. This can also be unequivocally detected by the control logic 50. This operation of the sensors 51, 52 with the control logic 50 has the advantage that cumbersome adjustment of the sensors 51, 52 with respect to the two sensing locations on the roller catch 11 or the pawl 20 are no longer needed. Suitable sensors are members, for example, Hall sensors, which respond to permanent magnets provided on 11 or 20 and entrained therewith.

Figure 3A:
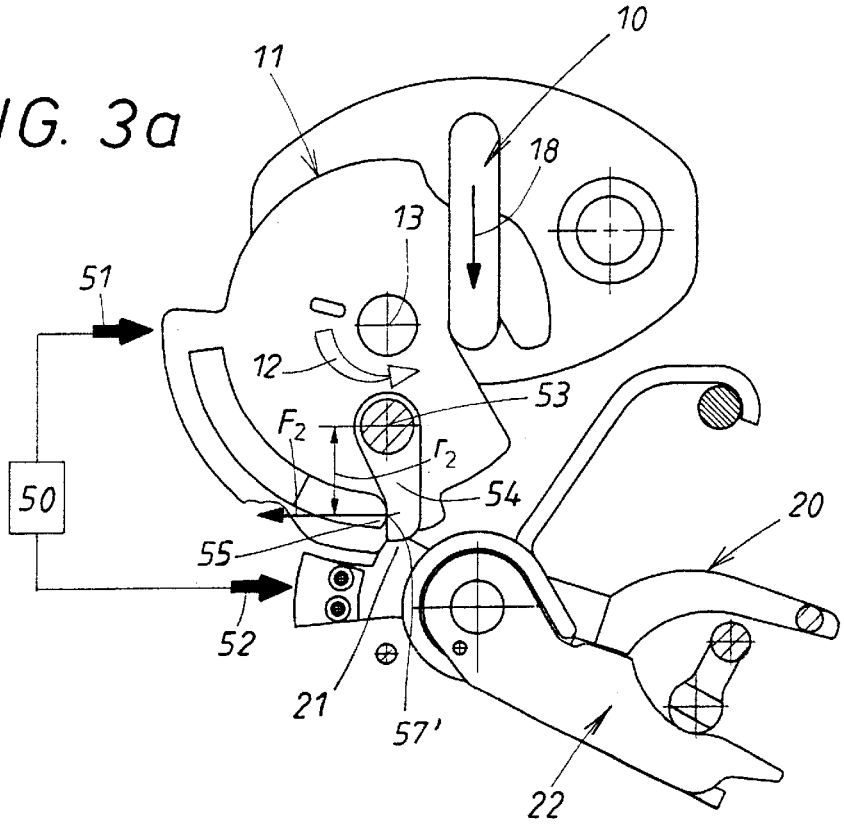

When the roller catch 11 has reached its pre-catch position illustrated in FIG. 2*a*, the control logic 50 will activate the "closing aid" until the main catch position of FIG. 3*a* has been reached. Then the closing aid will be deactivated which results in the position of the components illustrated in FIGS. 4*a* to 4*c*. The switching on and switching off of the closing aid is realized by the components of the lock according to the invention which are designed in a special way.

Figure 1B:
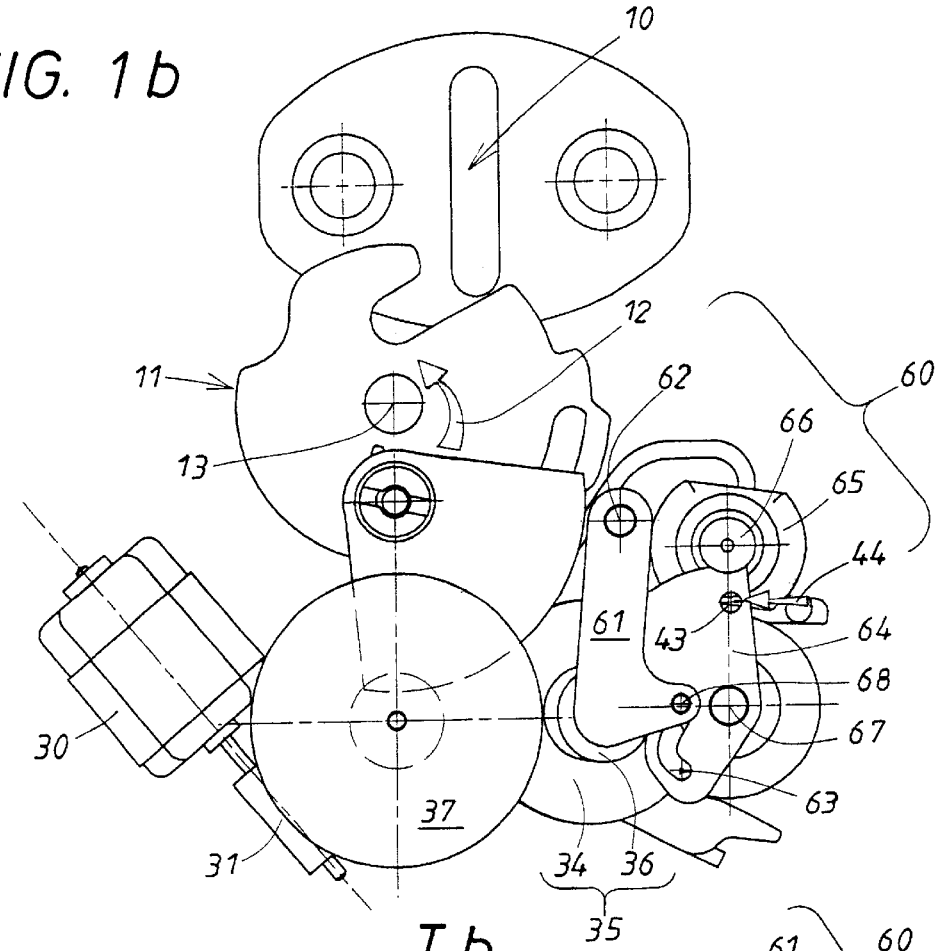
FIG. 1*b* a plan view onto the lock, in the viewing direction according to arrow Ib of FIG. 1*c;*
Figure 1C:
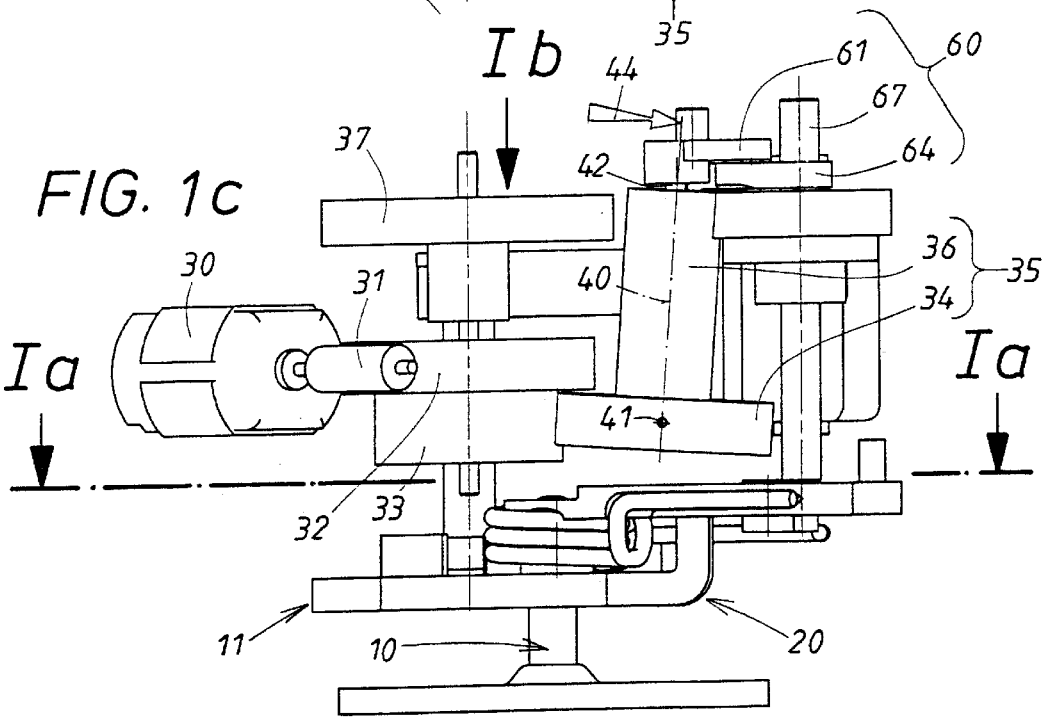
FIG. 1*c* a side view of the lock, wherein the housing is not illustrated.
Figure 1D:
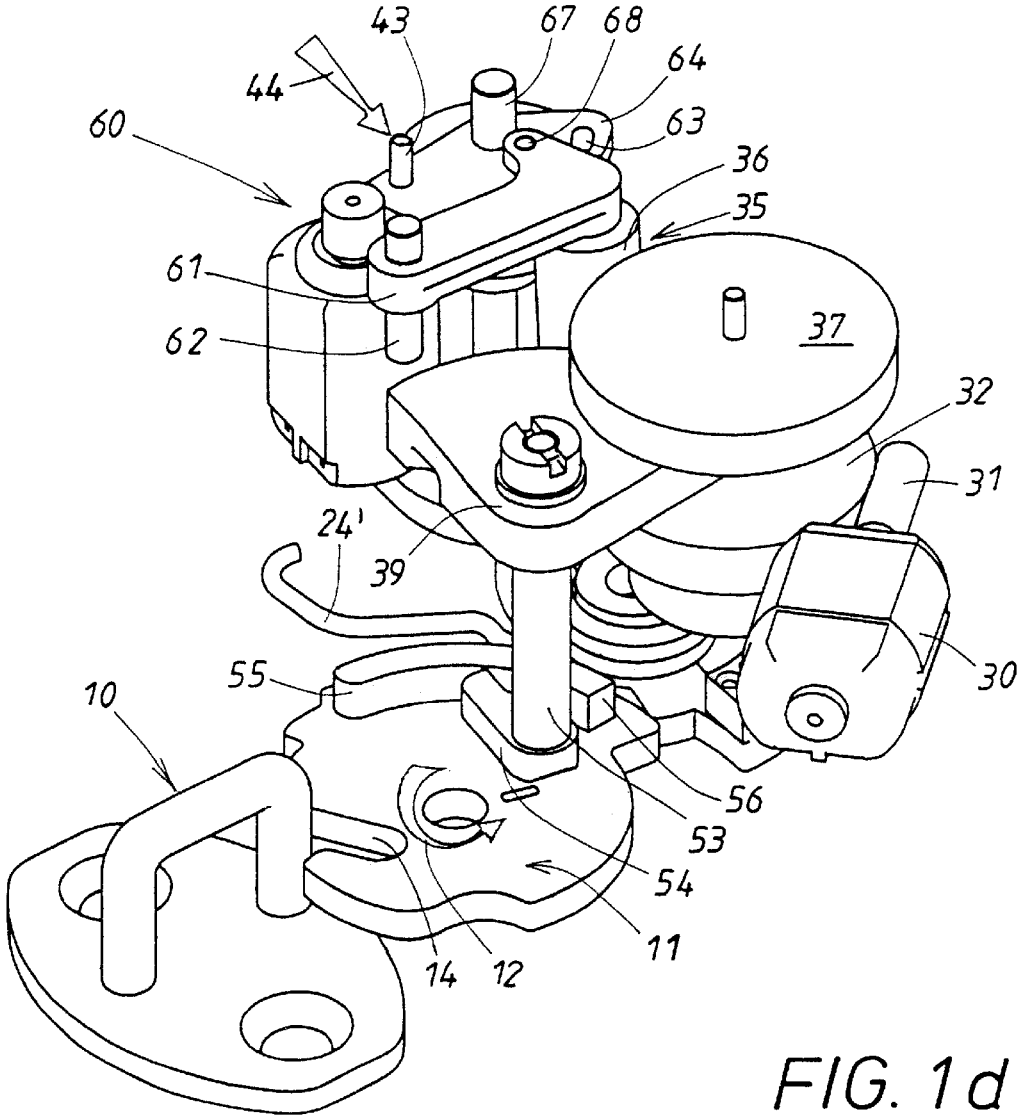
FIG. 1*d* a perspective representation of an important portion of the lock illustrated in FIGS. 1*a* to 1*c;*

As can be seen best in FIGS. 1*d* and 1*b*, 1*c*, the closing aid comprises in this embodiment an electrically operated drive motor 30 having arranged downstream thereof a reduction gear comprised of several members. They include a worm gear 31 rotatably driven by the motor 30 which engages a worm wheel 32. The worm wheel 22 is connected fixedly with the spur gear 33 for common rotation. Downstream of the spur gear 33 a special transmission member 35 is provided which in the present case is comprised of a tumbler wheel. The transmission member 35 can be switched between two switching positions, one of which is illustrated in FIG. 1*c* and the other in FIG. 2*c*. As can be taken from these Figures, the dash-dotted line illustrating the axle 40 of the tumbler wheel has two angle positions that differ from one another. The lower axle end indicated with 41 in FIG. 1*c* is shaped like a ball joint at a defined location in the lock housing, not illustrated in detail, while the oppositely positioned other axle end 42 is tiltingly movable and is pivotably supported on a switching device 60. The switching device comprises first a rocker 61 which is pivotably supported in the housing at 62, and is connected via a crank guide 63 with a toothed gear segment 64. The toothed gear segment 64 meshes with a pinion 66 of the motor 65 which is referred to as a "coupling motor" for reasons which will be disclosed in the following.

The tiltable axle end 42 of the tumbler wheel 35 in the present case is under the effect of a spring force indicated by the arrow 44 which has the tendency to maintain the axle 40 in the pivoted position, indicated in FIG. 1*c*, relative to the spur gear 37 arranged downstream. In this connection, an upper toothing 36 provided at the tumbler wheel reaches a decoupled position relative to the spur gear 37. On the other hand, a lower toothing 34 of the tumbler wheel 35 in this case remains still in engagement with the already mentioned spur gear 33 of this gear system. FIG. 1*c* accordingly corresponds to a switch-off position of the transmission member 35. The spring force 44 engages in a concrete embodiment on the pin 43 of the two segments 64, which pin is illustrated in FIGS. 1*b* and 1*d*. The tooth segment 64 is supported in the housing at location 67. A guide pin 68 provided on the rocker 61 comes to rest against one end of the crank guide 63, and this determines the switch-off position of the tumbler wheel 35 relative to the aforementioned downstream spur gear 37 of the gear system. In FIGS. 1*a* to 1*d* the drive motor 30 as well as the coupling motor 65 are standing still.

Figure 2B:
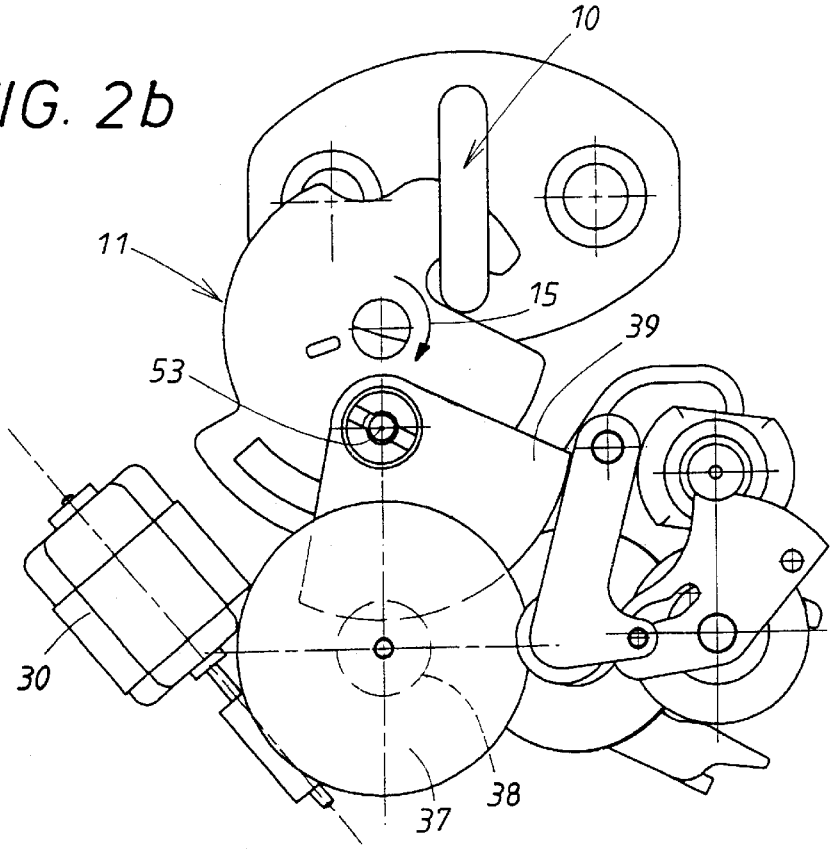
Figure 2C:
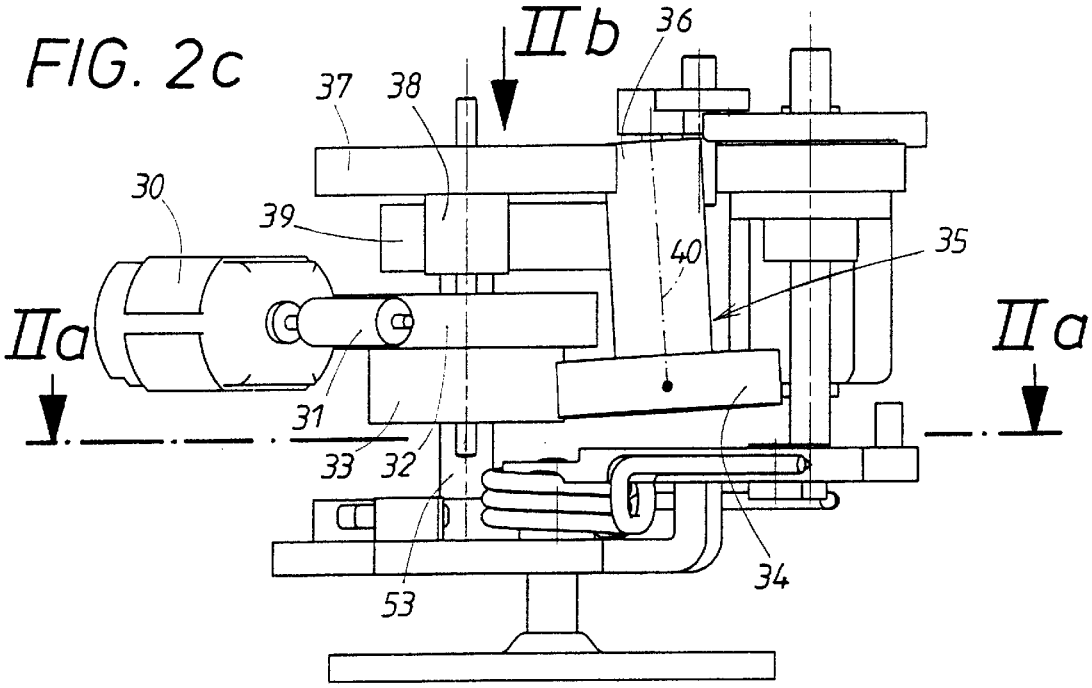

Upon further closing of the door, the locking part 10 entrains the roller catch 11 and brings it into the pre-catch position illustrated in FIGS. 2*a* to 2*c* where, as mentioned above, the pawl 20 drops into the pre-catch 16 of the roller catch 11. This fact, as has already been disclosed above, is detected by the sensors 51, 52 and reported to the control logic 50 which transfers the aforementioned transmission member 35, formed as a tumbler wheel, into the other position illustrated in FIG. 2*c*. Now the tumbler wheel 35 engages with its upper toothing 36 with the already mentioned spur gear 37. This provides a "switched-on" position of the transmission member 35. Now the drive motor 30 is supplied with electrical current.

The drive energy of the motor 30 transmitted via the gear members 31, 32, 33 to the transmission member 35 is now further guided by the output path arranged downstream of the transmission member 35 of the pulling-shut aid. This output path includes the already mentioned spur gear 37 which is fixedly connected on a pinion 38 for common rotation. Also provided is a toothed gear segment 39 engaging the pinion 38 und fixedly connected to a shaft 53 for common rotation. Moreover, an output member 54 of this output path is fixedly connected to the shaft 53 which, in the present case, is in the form of a lever. The lever 54 is supported with its free end on the shoulder 55 illustrated in FIG. 2*a*. The drive energy coming from the motor 30 results in a drive force provided via the transmission chain 31 through 39 and 53, 54 illustrated by the arrow F1. It has the effect that the roller catch 11 is entrained and moved further in the direction of the pivot arrow 15 of FIG. 2*b*. The locking part 10 engaging the roller catch 11 is also entrained until the main catch position of the roller catch 11 illustrated in FIG. 3*a* is reached. By means of the locking part 10 the door has been closed by motor forces according to the pulling shut arrow 18 illustrated in FIG. 3*a*. The gap of the door which was present up to this point is now closed.

Figure 3B:
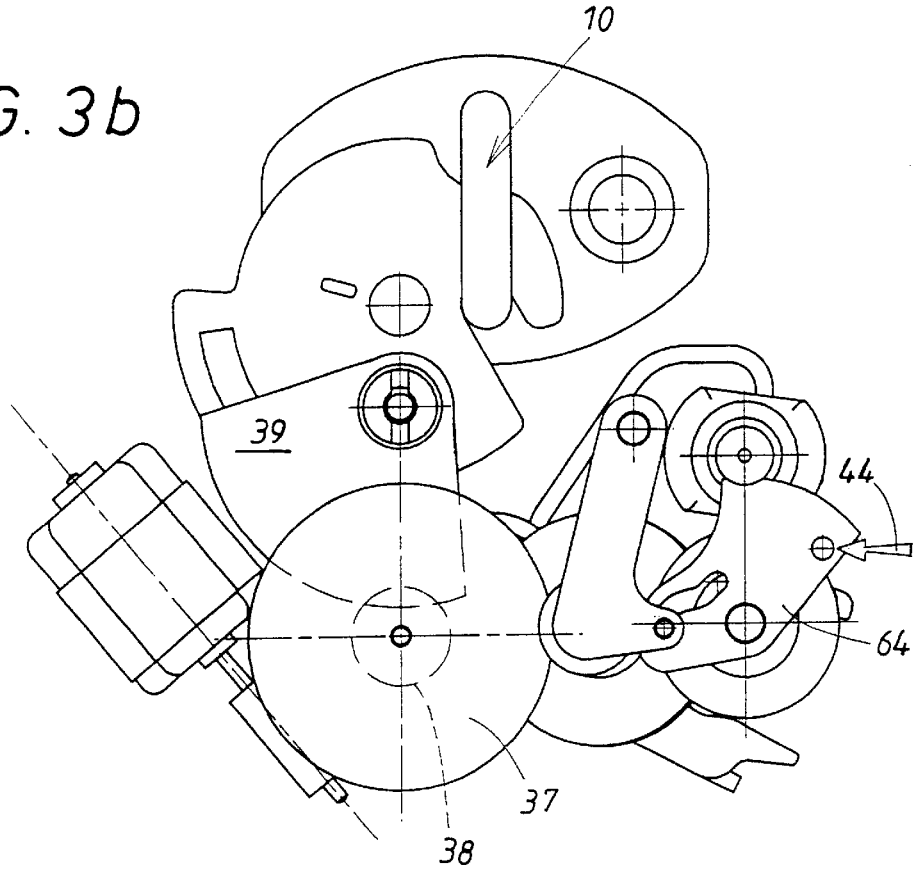
Figure 3C:
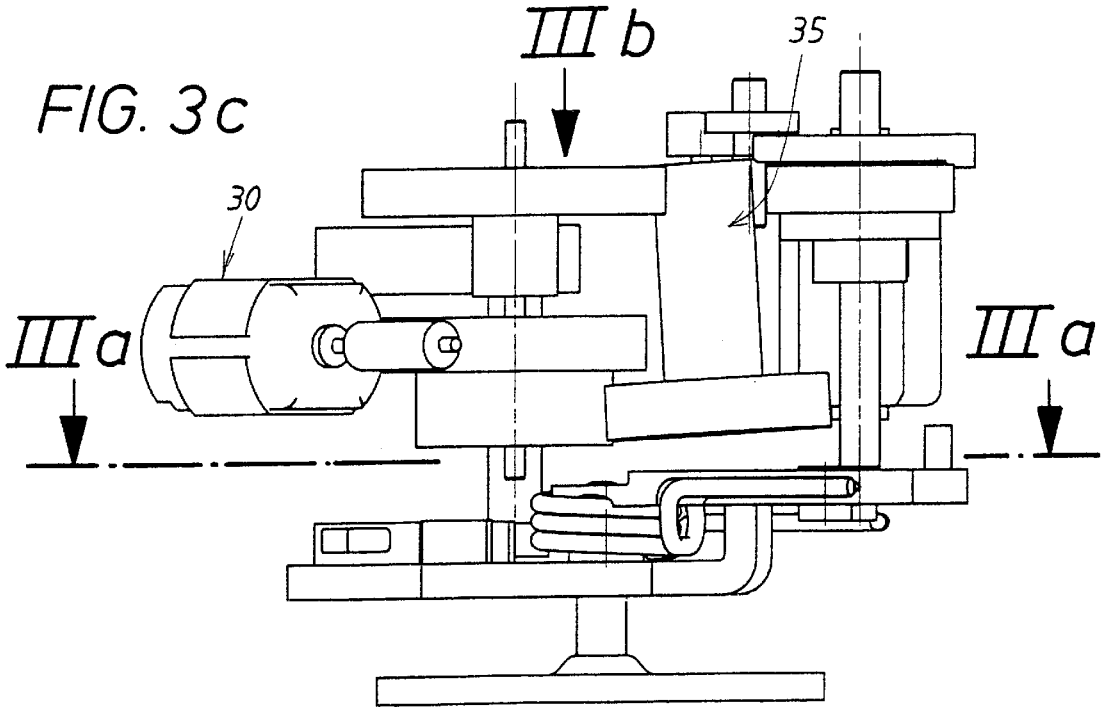

In FIGS. 3*a* to 3*c* the pulling shut movement 18 is still illustrated in its end phase where there is still a drive connection between the motor 30 and the output member 54 of the gear via the activated transmission member 35. In this last phase, the lever 54 provides a drive force F2 which provides a greater torque onto the roller catch 11 than in the case of the pre-catch position illustrated in FIG. 2*a* for the following reason.

The shoulder 55 for receiving the force F1 in FIG. 2*a* is the profiled end of an arc-shaped rib 56 seated on a disk surface of the roller catch 11. The contact location is indicated by 57 in FIG. 2*a*. The arm length r1 between the drive-active lever 54 and the contact location 57 on the control end 55 of the rib 56 is relatively small. The drive moment results thus as a product of r1 and F1. The corresponding torque acting on the catch roller 11 is determined by the torque arm r illustrated by a dash-dotted line in FIG. 2*a* and longer than r1 but also by the force component F1' which is smaller than F1. However, this ratio changes along the path to the main catch position of the roller catch 11 of FIG. 3*a*.

In FIG. 3*a* the contact location between the lever 54 and the shoulder 55 through 57' has been moved so that the corresponding arm length r2 of the torque exerted by 54 has become smaller. The spacing between the contact location 57' and the axis 13 of the roller catch 11 is in approximation identical to that of FIG. 2*a*. However, the force direction of F2 has also changed. The drive force F2 exerted by the lever 54 now acts fully on the roller catch 11, at least, however, with a substantially greater force component in comparison to FIG. 2*a*. The efficiency of the applied force F2 in comparison to F1 and F1' has become greater. The torque acting on the roller catch 11 in FIG. 3*a* is greater relative to FIG. 2*a*. The multiplication ratio of the gear between the drive motor 20 and the roller catch 11 has increased upon transition from FIG. 2*a* to FIG. 3*a*. The pulling force acting on the locking part 10 for pulling the door shut in the direction of arrow 18 has become greater.

This increase of the pulling force is very desirable. Between the door and the door frame there are, in general, elastic seals which in the last phase of the door closing movement must be compressed and therefore present a resistance to the pulling shut force. The thus resulting counter force increases thus in the last phase of the closing movement of the door. Also, the return force 12 acting on the roller catch 11 increases in this last movement phase. Accordingly, the sum of the counter forces, which occur during closing of the door and which must be overcome by the pulling shut aid, increases. Without the aforementioned increase of the pulling force according to the invention the operating point of the drive motor 30 which is embodied as a DC motor would be displaced because of the increasing counter force. Accordingly, a smaller rpm would result in accordance with the operating characteristic line of the motor 30 as a result of the increased motor load. The rpm determines however the motor noise. A change of rpm thus results in a change of the motor noise to lower frequencies, which is perceived as uncomfortable.

According to the invention, it is easily possible with the aforementioned means to compensate the increase of the counter force so that the rpm of the drive motor during the entire pulling shut phase is substantially maintained constant. During pulling shut of the door this results in a very pleasant, uniform motor noise. The invention thus makes it possible to operate the drive motor 30 during the entire pulling shut movement substantially at the same operating point of its characteristic line.

Figure 4A:
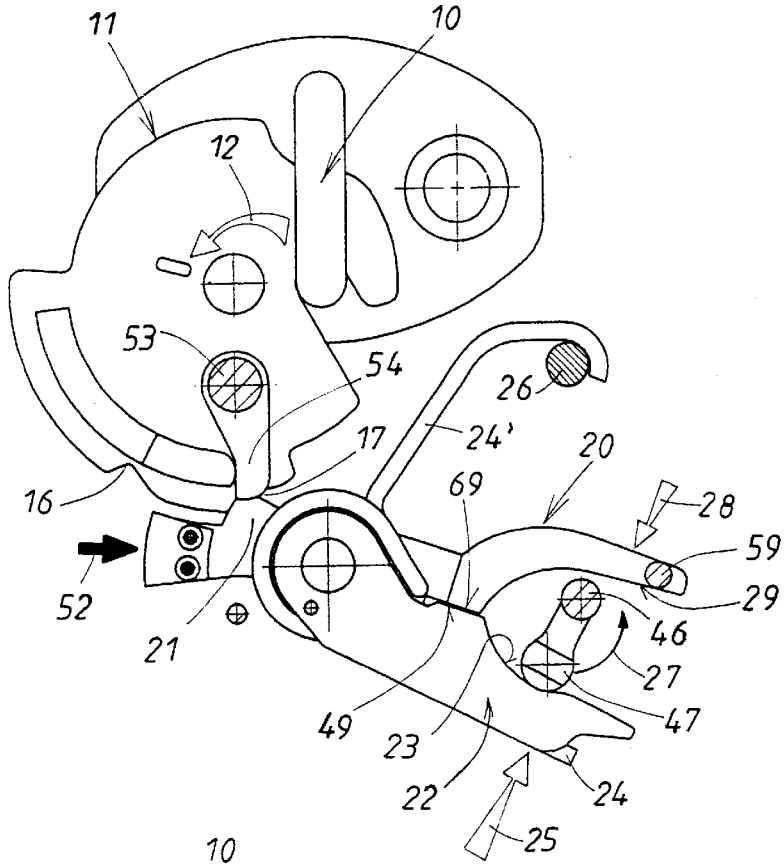
FIGS. 4*a*–4*c* the same plan and side views of the lock, wherein the roller catch is also in the main catch position illustrated already in FIGS. 3*a* to 3*c* but the closing aid has been switched off.
Figure 4B:
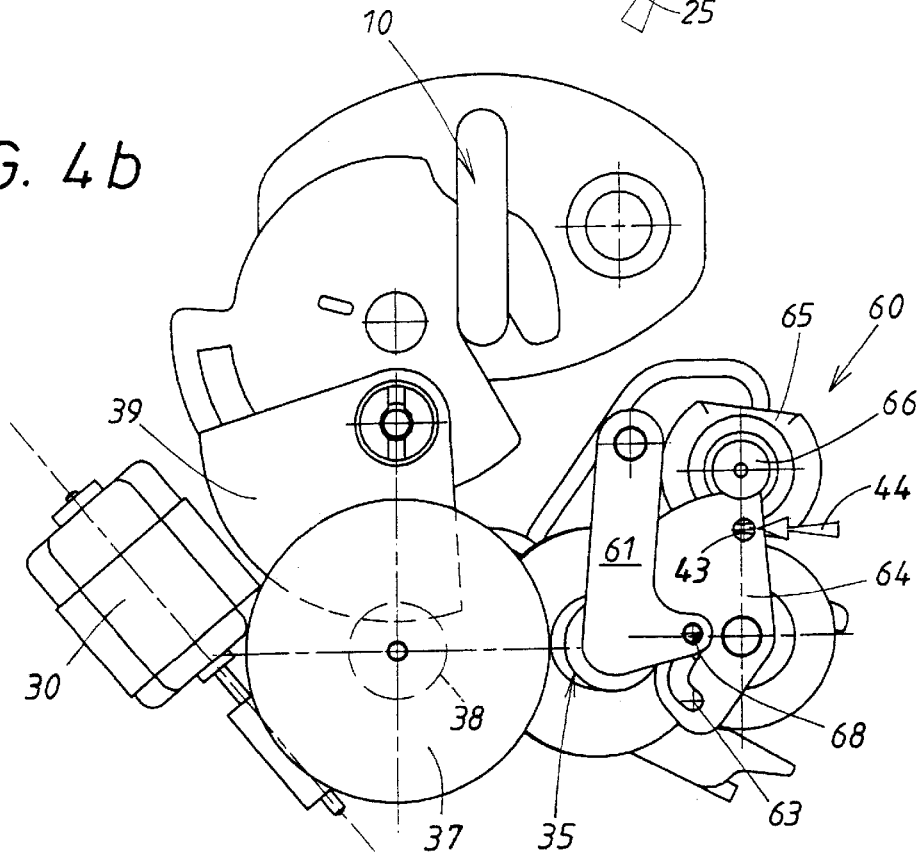
Figure 4C:
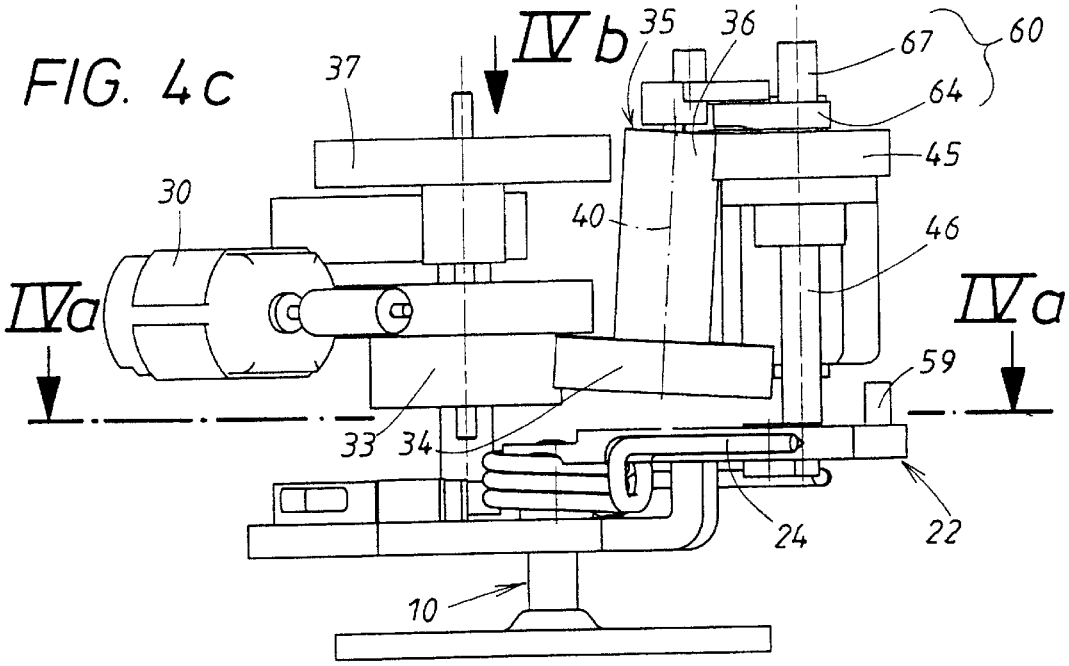

When, as already disclosed, the sensors 51, 52 have recognized the main catch position of FIG. 3*a*, the control logic moves the described transmission member 35 again into its switched-off position which can be seen in FIGS. 4*a*–4*c*. The tumbler wheel 35 in FIG. 4*c* is again in the angular position with its axis 40 pivoted away. This is carried out in that the switching device 60 is made inactive. For this purpose, the coupling motor 65 must only be switched off. This can have an effect on the spring force 44 acting on the transmission member 35, against which previously the switching device 60 had worked by applying an electric current to the coupling motor 65. Because of the described point of attack of the spring force 44 on the pin 43 of the toothed gear segment 64, the toothed gear segment 64 is moved back from its position in FIG. 3*b* into the position of FIG. 4*b*. Accordingly, the guide pin 68 of the rocker 61 is moved to the other end of the crank guide 63 of the two gear segment 64.

This switched-off position of the transmission member 35 from the aforementioned further drive path 37 to 39 and 53, 54 is especially of great importance when during the previously described pulling-shut phase between FIG. 2*a* and 3*a* an emergency situation occurs which requires that the further closing of the door is immediately stopped. Such an emergency situation can be detected by the electric control logic in that, for example, the time required for the pulling shut process has been exceeded or that the electric current for driving the drive motor 30 has increased past a permissible limit or that power failure occurs. In this case, already on the way to the main catch position of the roller catch 11 of FIG. 3*a*, the current supply of the coupling motor 65 is switched off. Already on the path, before reaching FIG. 3*a*, a decoupling of the transmission member 35 from the drive path 37 to 39 and 53, 54 of the pulling-shut aid positioned downstream is carried out. Even when according to the inertia principle the drive motor 30 set in motion and the moved drive members 31 to 33 in front of the transmission member 35 continue to run, the movement energy of these masses is no longer transmitted onto the roller catch 11. The roller catch 11 no longer moves any farther, it can even be returned for the following reason.

Because of the elastic effect of the already mentioned door seals a counter force results. This counter force is sufficient in any case to move the roller catch 11 in an emergency situation again into its pre-catch position of FIG. 2*a*. Such a switching off of the transmission member 35 can, of course, also be achieved by a manual actuation of an inner grip belonging to the door lock, an outer grip, or a remote control. In the main catch position of the roller catch 11 of FIG. 4*a* to 4*c*, of course, the drive motor 30 is also automatically switched off by the control logic.

The invention is also provided with an opening aid which can be activated by actuation of the inner or outer handle of the door or by actuation of a remote control. When pulling shut the door, the opening aid can also be actuated by the vehicle user. When desired, the opening aid can also be actuated automatically by the control logic 50 when the aforementioned emergency situation during closing of the door is present. In the switched-off position of FIG. 4*c* with respect to the spur gear 37 belonging to the pulling shut aid, the transmission member 35, as shown in FIG. 4*c*, is actually in connection with the following drive path provided as the opening aid.

In this case, according to FIG. 4*c*, the lower toothing 34 of the tumbler wheel 35 is still in engagement with the upstream spur gear 33. Accordingly, a rotation of the drive motor 30 is now transmitted via the upper toothing 36 of the tumbler wheel 35 onto another spur gear 45 which is fixedly connected for common rotation to a shaft 46.

The drive motor 30 rotates by the way in the same rotational direction as the previously described pulling shut aid according to FIGS. 2*a* to 3*c*. The upper end 67 of this shaft 46 can serve at the same time as the aforementioned bearing for the toothed wheel segment 64 belonging to the switching device 60. A control cam 47, illustrated in FIG. 4*a*, is fixedly connected to the shaft 46 and forms the output of the drive path 45, 47 belonging to the opening aid. In FIG. 4*a* the rest position of this control cam 47 is illustrated. In this connection, the control cam 47 is supported on a control surface 23, shown in FIG. 4*a*, of a further lever 22 onto which the force 25 of a two-leg spring 24, 24' acts. One spring leg 24' is supported on a stationary support location 26 in the housing while the other leg 24 provides the spring force 25, indicated in FIG. 4*a* by the arrow 25, acting on the lever 22. The spring 24, 24' represents a force storage for the lever for which reason the lever 22 in the following will be referred to as "storage lever".

In the initial position of FIG. 4*a* the spring force 25 of the storage lever 22 cannot yet act on the pawl 20 because, as mentioned above, the control cam 47 supports the storage lever 22 on its control surface 23. However, this will change when for activation of the opening aid the drive motor 30 is further supplied with electrical current. Then the control cam 47 according to FIG. 4*a* is moved in the direction of the rotational path 27 via the aforementioned second drive path 45 to 47 and releases increasingly the storage lever 22. The pawl 20 is also under a spring load 28 in the counter direction as illustrated by arrow 28; even though, the higher spring force 25 exerted by the storage lever 22 is normally sufficient in order to lift the locking arm 21 of the pawl 20 out of the main catch 17 of FIG. 4*a* or the pre-catch 16 of FIG. 2*a*. The force transmission between the storage lever 22 and the pawl 20 is realized via the contact surface and counter contact surface 49, 49 according to FIG. 4*a*. Then the roller catch 11 is free and can be returned by the restoring force 12 acting on it into its open position of FIG. 1*a*. Now the locking part 10 is again released and the door can be opened.

Figure 5A:
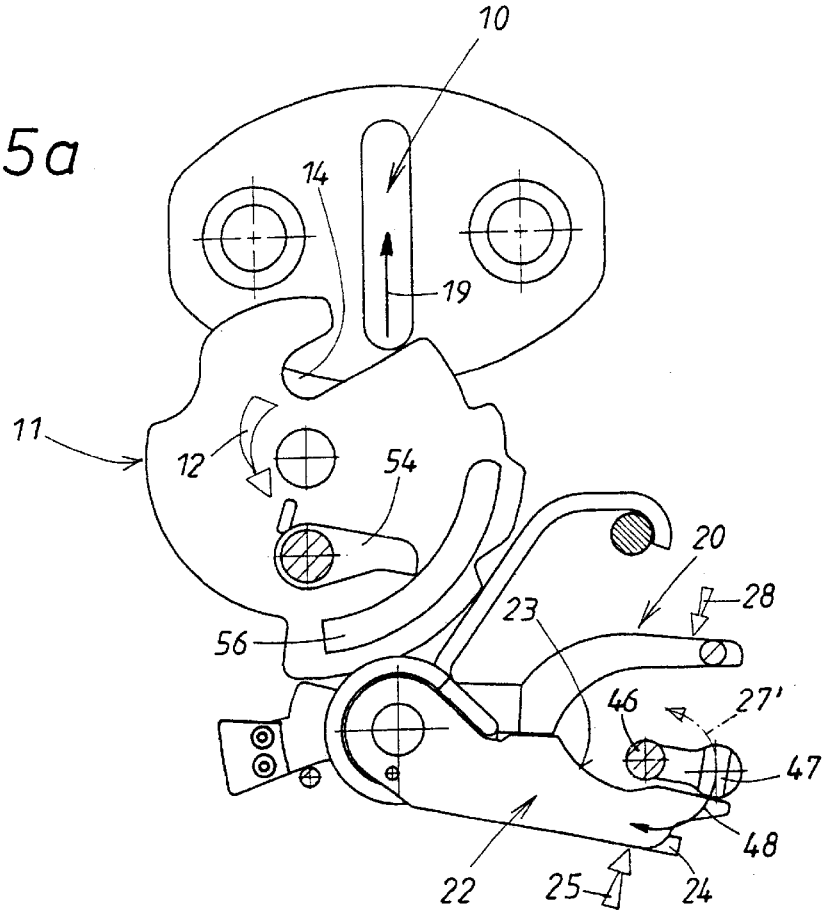
FIGS. 5*a*–5*c* the aforementioned views of the lock according to the invention after an opening aid has been activated and the roller catch has been returned into the open position illustrated in FIGS. 1*a* to 1*c;*
Figure 5B:
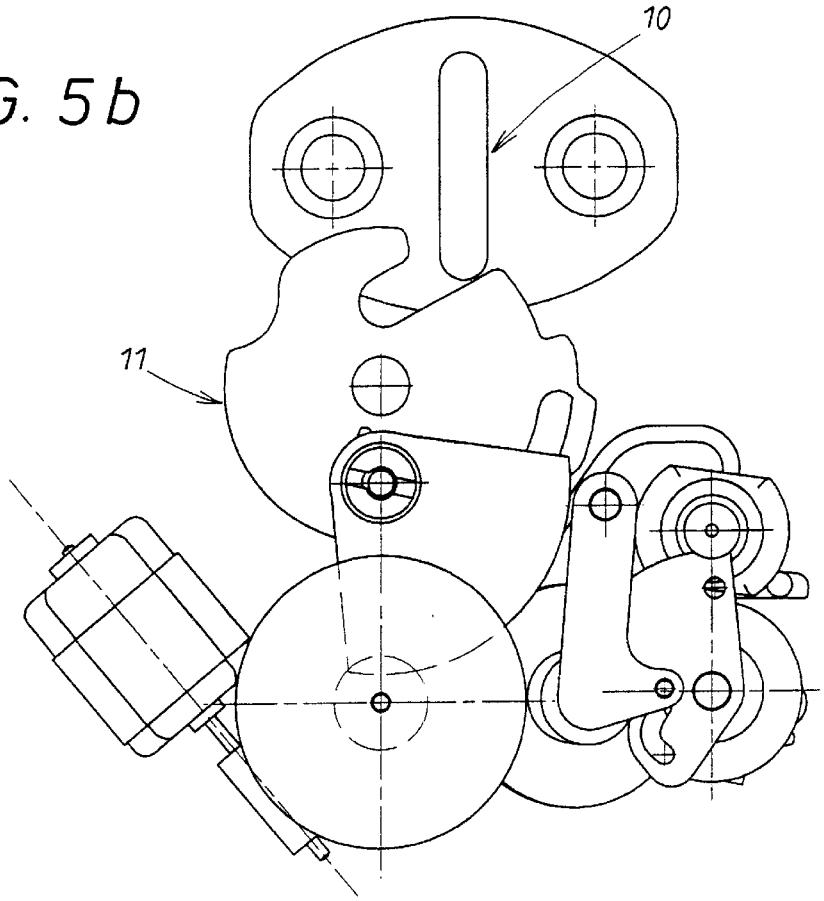
Figure 5C:
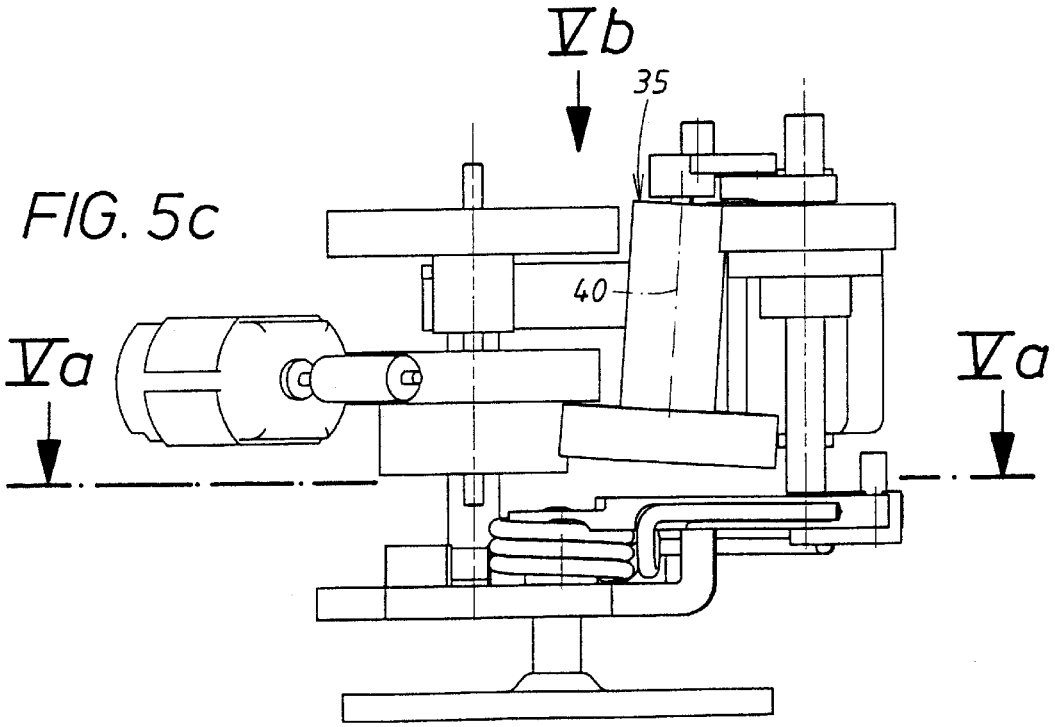

The end phase of the opening movement can be seen in FIGS. 5*a* to 5*c*. The locking part 10 has moved away relative to the roller catch 11, in comparison to the situation of FIG. 4*a*, in the direction of the opening arrow 19 of FIG. 5*a*. The roller catch 11 has returned into the open position as a result of its restoring force 12. The locking part 10 has been released from the receiving device 14 in the roller catch 11. The rotation 27 of the control cam 47 described in FIG. 4*a* is usually completed even before the control cam has reached a counter control surface 29 which, in this embodiment, is located on an extended arm of the pawl 20. In a crash situation, however, or in other disturbances, it may occur that the pawl locking arm 21 is seated so tightly in the main catch 17 of the roller catch 11 that the spring force 25 of the locking lever 22 is not sufficient for releasing the pawl 20. This is detected by sensors, for example, the described pawl sensor 52. The drive motor 30 turns past the rotational position of the cam 47 illustrated in FIG. 5*a*. This is illustrated in FIG. 5*a* by the dashed arrow 27'. The cam 47 contacts, either in the case of the pawl engagement at 17 illustrated in FIG. 4*a* or at 16 in FIG. 2*a*, the aforementioned counter control surface 29 and forces the pawl locking arm 21, with enhancement by the storage spring force 25, out of the main catch 17 or pre-catch 16.

After lifting the pawl 20 in the described disturbance situation or in the previously described normal situation of FIGS. 5*a* to 5*c*, the control cam 47 is again returned by the motor, in particular, in the direction of the counter rotation arrow 48 illustrated in FIG. 5*a*. This is again made possible by the drive motor 30 because there is still a drive connection with the drive path 45 to 47 of the opening aid of the gear. For this purpose, the motor 30 must only be supplied with electric current in the opposite direction. The control cam 47 then again meets the control surface 23 of the storage lever 22 and moves it under tension of the movable spring leg 24 again into the rest position of FIG. 1*a*. All of this can again be monitored by sensors. When the storage lever 22 is again in its initial position of FIG. 1*a*, the counter current loading of the drive more 30 for this counter rotation 48 is stopped.

As has been mentioned already, the left position of the roller catch 11 according to FIG. 1*a* to 1*d* of the first drive path 37 to 39 as well as 53, 54, belonging to the pulling shut aid and positioned downstream of the transmission member 35, is switched off. This gear portion is free. This results already after switching off the transmission member 35 in the main catch position of the roller catch 11 of FIG. 4*a* to 4*c*. At this point, no drive force coming from the drive motor 30 is exerted on the lever 54. It can rest in the open position of FIG. 1*a* or 5*a* on the inner arc surface 58 of the rib 56. A light spring tension acting on the lever 54 provides a defined position of the lever 54 on this arc surface 58. This light spring tension also makes sure that, already before the beginning of the pulling shut movement according to FIG. 2*a* to 2*c*, the lever 54 is positioned at the described contact location 57 of the shoulder 55 according to FIG. 2*a*.

For releasing the pawl 20 via an outer and/or inner handle or a remote control, a point of attack is provided, for example, a release pin 59 as illustrated in FIGS. 4*a* and 4*c*. Otherwise, the aforementioned counter control surface 29 can be provided, instead of on the pawl 20, on the storage lever 22 and can be a monolithic, fixed component of the storage lever 22. In this case, the pawl 20 is shortened in its length relative to that of FIGS. 1*a* to 5*a*. In this case, the contact surface 49 on the storage lever 22 and the correlated counter contact surface 69 on the pawl 20 according to FIG. 4*a* are, however, maintained in order to be able to transmit the spring force 25 of the storage lever 22 as an opening aid onto the pawl 20, as has been disclosed above. The one-part connection of the control and counter control surfaces 23, 29 on the storage lever 22 can be provided in the form of an eye at the lever end area of the storage lever 22, wherein the control cam 47 engages the eye opening. The eye has approximately an elongate oval shape with profiled edges. The control cam 47 then has a profiled contour. The control and counter control surfaces 23, 29 are then positioned at oppositely arranged edges of this eye. This configuration has special advantages and, independent of the embodiments of the aforementioned Figures, has its own inventive importance.

As has been mentioned above, the control means for determining the respective position of the door, as disclosed in connection with FIGS. 1*a* to 5*c* and explained in connection with the table according to FIG. 8*a*, have independent inventive importance. They can also be used in connection with a door lock that has neither a pulling-shut aid nor an opening aid or is provided only with an opening aid. The resulting advantages have already been disclosed in detail in the introductory portion of the description. The FIGS. 6*a* to 6*c*, on the one hand, and FIGS. 7*a* to 7*c*, on the other hand, show, based on the most important components of such door locks, two possibilities for the configuration of the control means.

Figure 6A:
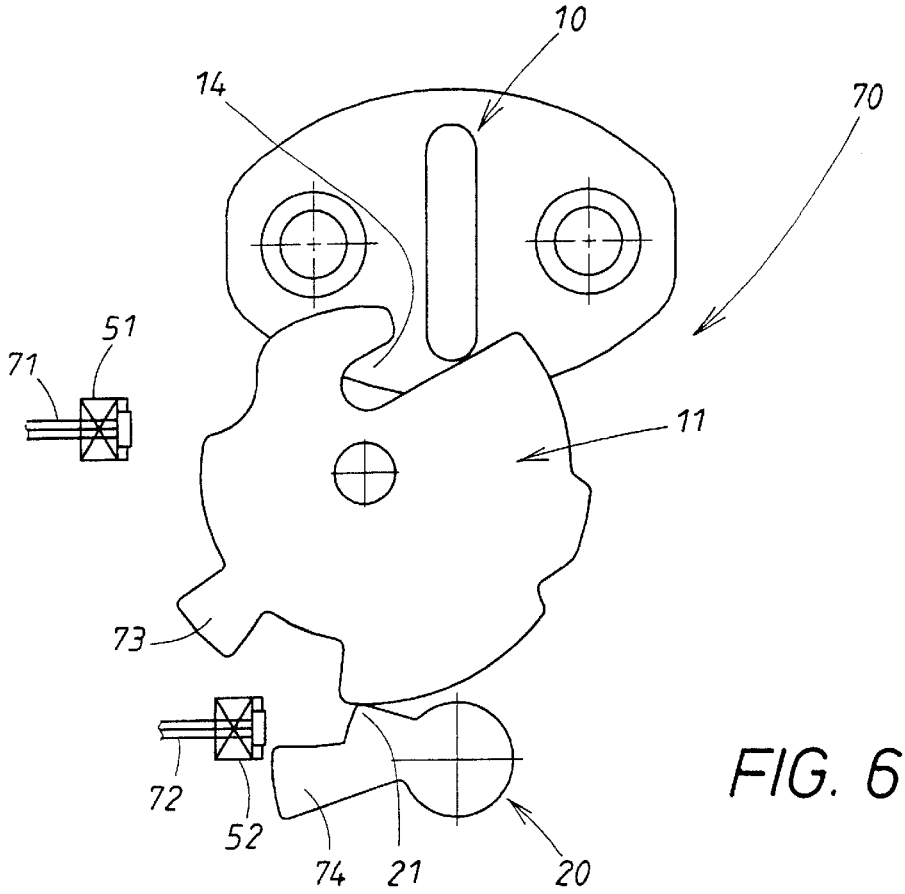
FIGS. 6*a*–6*c* a differently embodied door lock of which only the three most important components are illustrated, together with two control means, which allow determination of the respective position of the door reliably.

In FIG. 6*a* only the roller catch 11, the pawl 20 which has been changed as disclosed in the last embodiment, and the two described sensors 51, 52 of a door lock 70 are shown. The sensors 51, 52 can be of any suitable configuration as is known in the art. They can be comprised of a mechanical or optical switch, a reed contact, a Hall sensor or other so-called sensor wire elements. The position illustrated in FIG. 6*a* corresponds to that of FIG. 1*a* which has been explained already with the aid of FIG. 8*a*, line 1. In this case, both sensors 51, 52 do not send a signal to the corresponding control logic 50, which is shown in FIG. 1*a* while in FIG. 6*a* only the electrical connecting lines 71, 72 extending to the sensors are illustrated. The open position of the door is now unequivocally determined.

The situation of this door lock 70 illustrated in FIG. 6*b* corresponds to the door position already explained in connection with FIG. 2*a*. The locking part 10 is already positive-lockingly engaged by the roller catch 11 and the pawl 20 has dropped with its locking location 21 into the pre-catch. The roller catch 11 as well as the pawl 20 have flaps 73 and 78, respectively, which in this door position reach into the area of the sensors 51, 52. Subsequently, as already explained in connection with the curve 8*a*, the pre-catch position of the door is detected because both sensors 51, 52 send a signal to the control logic 15 which is not shown in detail in FIG. 6*b*.

Figure 6B:
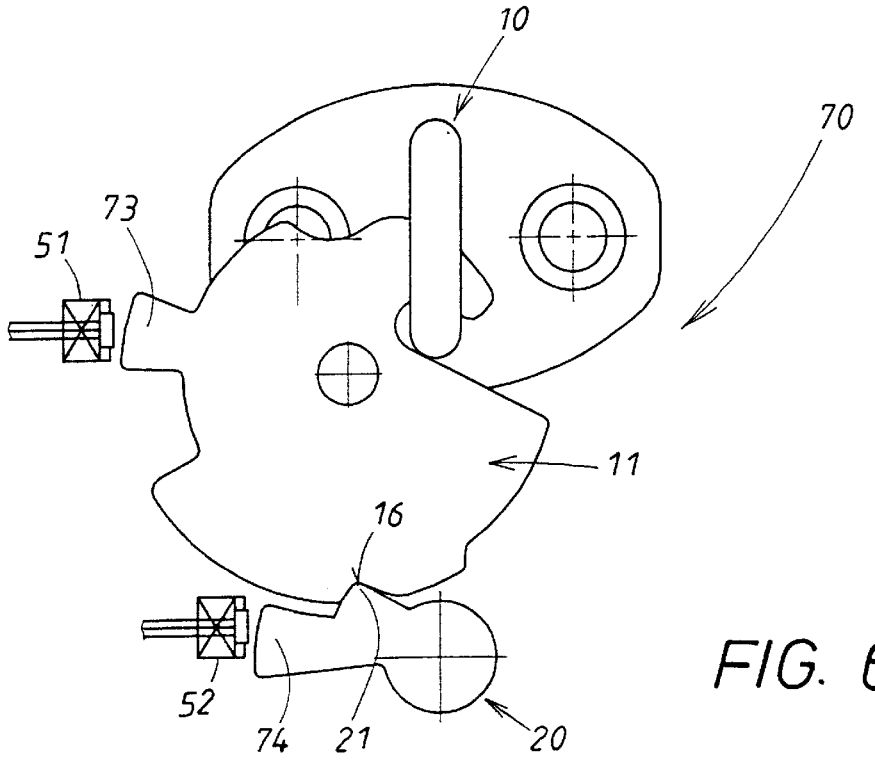
Figure 6C:
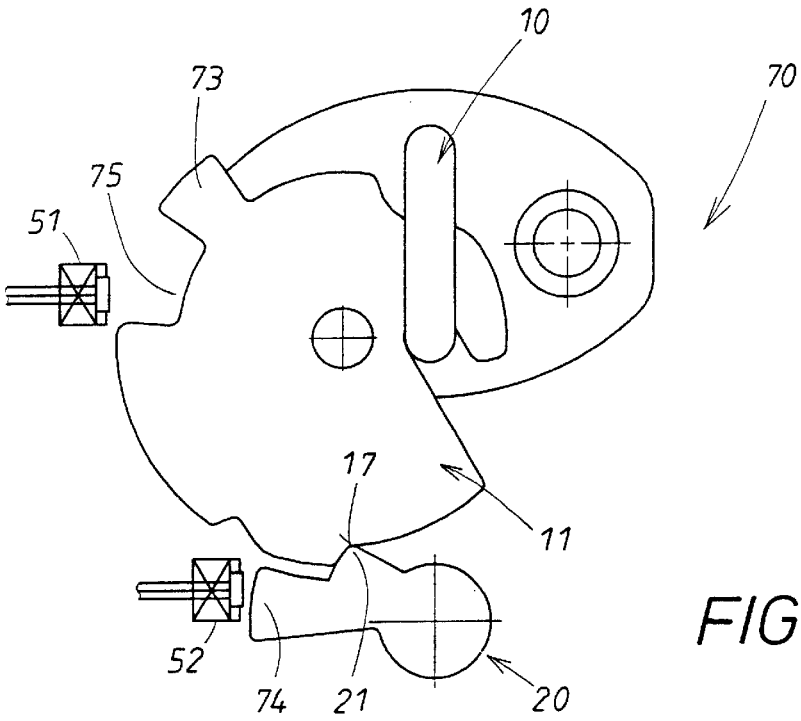

In FIG. 6*c* the main catch position of the door is present which has already been explained in connection with FIG. 4*a*. The locking location 21 of the pawl 20 is then in the aforementioned main catch 17 of the roller catch 11. The door is not completely closed. This is detected by means of the signals sent by the two sensors 51, 52 to the control logic 50, as has been explained above in connection with the last line of FIG. 8*a*. This can be seen in FIG. 6*c* in that the aforementioned flap 74 at the pawl 20 results in the signal "1". At the roller catch sensor 51, on the other hand, the corresponding flap 73 is removed and, instead, a cutout 75 of the roller catch 11 is in alignment with the sensor 51. Accordingly, the sensor 51 is not activated. The control logic 50 in this scenario only receives the signal "0" from the sensor 51, as can be seen in the table of FIG. 8*a*.

Figure 7A:
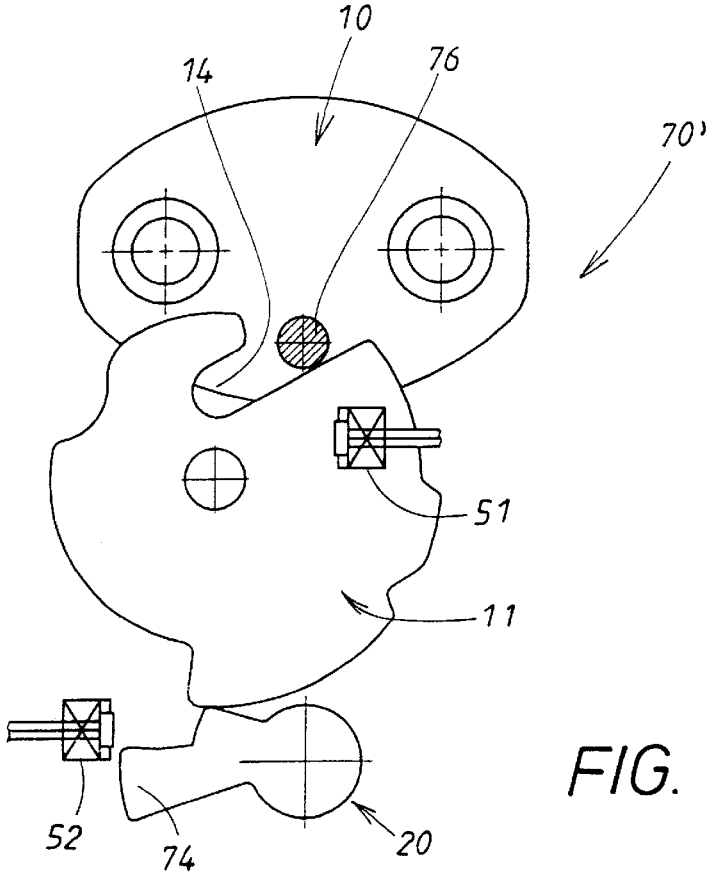
FIGS. 7*a*–7*c* in a representation corresponding to FIGS. 6*a* to 6*c* a variation of the embodiment of the control means.
Figure 7B:
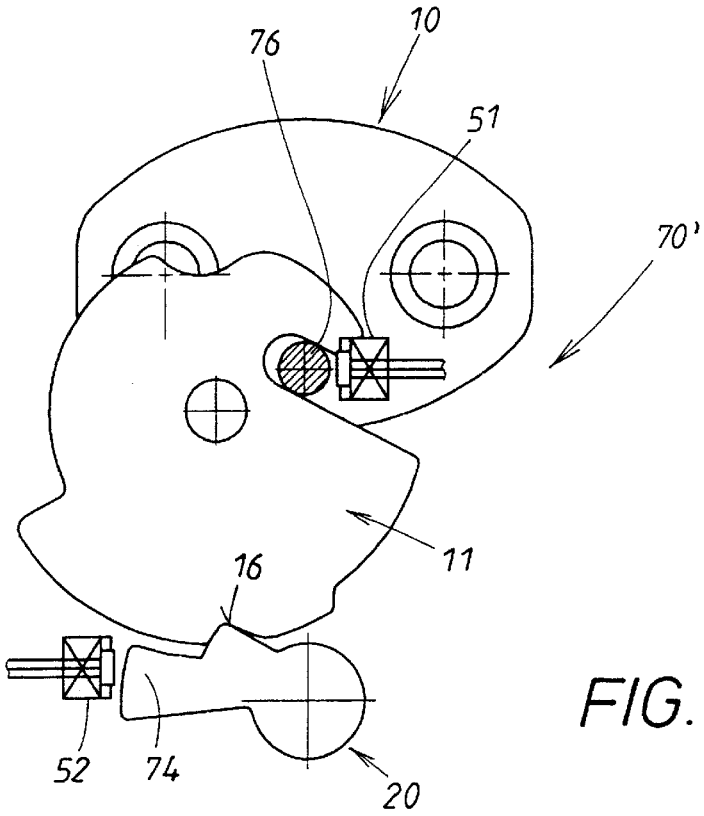
Figure 7C:
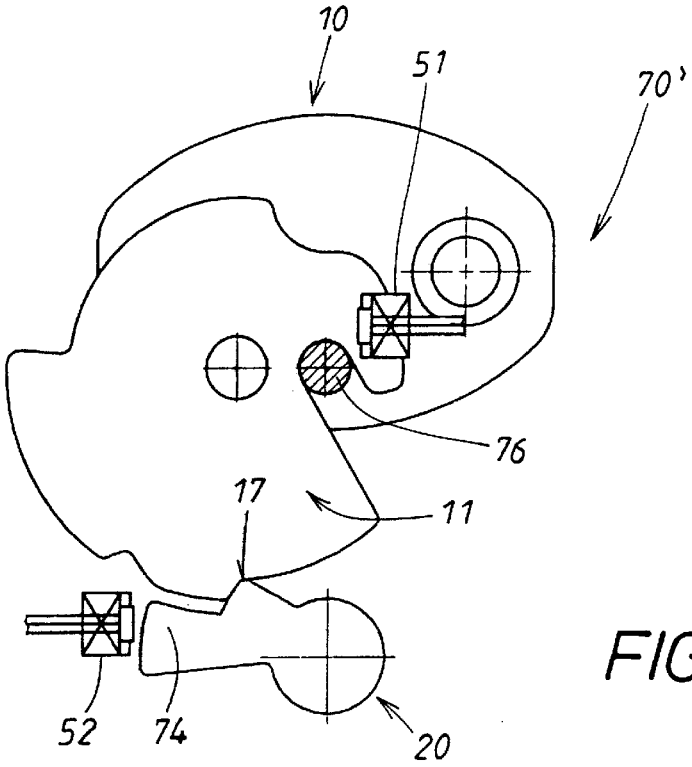

In FIG. 7*a* to 7*c* an alternative embodiment of the door lock 70' is shown, in particular, again in the same three positions as explained supra in connection with the lock 70 in FIG. 6*a* to 6*c*. Therefore, the above description applies here also. It is sufficient to only point out the differences.

In the door lock 70' of FIGS. 7*a* to 7*c* only the bolt 76 of the locking part 10 is illustrated which has not yet been engaged by the receiving device 14 of the roller catch 11 in the open position illustrated in FIG. 7*a*. This bolt 76 could be formed by one leg of a bracket-shaped locking part 10 as is illustrated perspectively in FIG. 1*d*. In deviation from the previously disclosed door lock 70 the sensor 51 in the door lock 70' of FIG. 7*a* to 7*c* does not cooperate with the roller catch 11 but with the locking bolt 76. Accordingly, in the door lock 70' the aforementioned flap 73 of FIGS. 6*a* to 6*c* can be eliminated. In analogy to FIGS. 6*a*, the sensor 51 in door lock 70' sends the signal "0" to the control logic 50 in the position illustrated in FIG. 7*a*.

When the door is in the pre-catch position according to FIG. 7*b*, the locking bolt 76 has reached the area of the corresponding sensor 51, and, therefore, a positive signal is sent to the corresponding control logic 50. Such a positive signal is provided because of the already described position of the pawl flap 74, provided also in the lock 70', at the pawl sensor 52, as has already been described in connection with FIG. 6*b*.

In FIG. 7*c* the main catch position of the door is now present. The locking bolt 76 has been removed from the sensor 51 so that again the signal "0" is provided. For the same reason as in FIG. 6*c*, the pawl sensor 52 in this case provides a positive signal.

In FIGS. 8*b* to 8*d* three further tables for the control logic 50 are listed which may result for a variation of the embodiment of the door locks 70 or 70'. As can be seen in the tables, the signals in the different positions are correlated in a different way relative to FIG. 8*a*, but they are always unequivocal for the control logic. Therefore, as has been explained in connection with FIG. 6*a* to 7*c*, the logic can unequivocally detect each of the three positions of the door based on the signals. In order to obtain these signal variations in the three different door positions, it is only necessary to position the two sensors 51 and 52 differently relative to the afore described control locations 73, 74, 75 of the roller catch 11 and the pawl 20 or relative to the control bolt 76. Another possibility is, of course, to position these control locations 73 to 76 differently while taking over the positions according to FIG. 6*a* to 7*c* for the two sensors 51, 52.

LIST OF REFERENCE NUMERALS

10 locking part
10' release position of 10
11 roller catch
12 arrow of restoring force of 11
13 bearing pin of 11, rotary axis
14 receiving device of 11 for 10
15 pivot arrow of 11 for closing or pulling shut
16 pre-catch of 11
17 main catch of 11
18 arrow of pulling shut movement of door (FIG. 3*a*)
19 arrow of opening movement of door (FIG. 5*a*)
20 pawl
21 locking arm of 20; locking location
22 storage lever
23 control surface on 22
24 first movable spring leg for 22
24' second supported spring leg for 22
25 arrow of spring force of 24 (FIG. 4*a*)
26 support location of 24' (FIG. 4*a*)
27 arrow of rotational movement of 47 for releasing 22
27' further rotation of 47 in a crash situation (FIG. 5*a*)
28 arrow of own spring-load of 20
29 counter control surface on 20 for 47 (FIG. 4*a*)
30 drive motor
31 worm gear
32 worm wheel
33 spur gear
34 lower toothing of 35
35 transmission member, tumbler wheel
36 upper toothing of 35
37 spur gear, pulling shut drive path
38 pinion, pulling shut drive path
39 tooth gear segment, pulling shut drive path
40 axle of 35
41 first stationary axle end of 40
42 second movable axle end of 40
43 pin on 64 for 44
44 arrow of spring force for 35
45 spur gear, opening drive path
46 shaft, opening drive path
47 control cam, opening drive path
48 arrow of counter rotation of 47 (FIG. 5*a*)
49 contact surface on 22 (FIG. 4*a*)
50 control logic
51 first sensor, roller catch sensor
52 second sensor, pawl sensor
53 shaft, pulling shut drive path
54 output member of pulling shut drive path, lever
55 shoulder for 54, control end of 56
56 arc-shaped rib on the 11 (FIG. 2*a*)
57 first contact location between 55, 54 (FIG. 2*a*)
57' second contact location between 55, 54 (FIG. 3*a*)
58 inner arc surface of 56 (FIG. 1*a*)
59 release pin on 20 (FIGS. 4*a*, 4*c*)
60 switching device
61 rocker of 60
62 bearing of 61
63 crank guide in 64
64 tooth gear segment
65 coupling motor for 60
66 pinion
67 bearing of 64, shaft end of 46
68 the guide pin on 61 for 63
69 counter contact surface on 20 (FIG. 4*a*)
70 door lock (FIGS. 6*a* to 6*c*)
70' door lock (FIGS. 7*a* to 7*c*)

71 electric line for 51
72 electric line for 52
73 flap on 11 (FIG. 6*b*)
74 flap on 20 (FIG. 6*b*)
75 cutout on 11
76 locking bolt of 10 at 70' (FIGS. 7*a* to 7*c*)
F1 drive force of 54 (FIG. 2*a*)
F1' force component of F1 for 11 (FIG. 2*a*)
F2 drive force of 54 (FIG. 3*a*)
r arm length vpm drive moment for 11 (FIG. 2*a*)
r1 arm length for drive torque of 54 (FIG. 2*a*)
r2 arm length for drive torque of 54 (FIG. 3*a*)

What is claimed is:

1. A door lock for a vehicle, comprising:

a roller catch (11) having a pre-catch (16) and a main catch (17);

a locking part (10) inserted into the roller catch (11) during closing of a door of the vehicle and configured to pivot the roller catch (11) from an open position via a pre-catch position into a main catch position;

a pawl (20) configured to drop into the pre-catch (16) in the pre-catch position of the locking part (10) and to drop into the main catch (17) in the main catch position of the locking part (10);

a motorized closing aid for the door of the vehicle, wherein the motorized closing aid is comprised of a drive motor (30) and a gear (31 to 39; 53, 54) acting on the roller catch (11);

a motorized opening aid for the door lock, wherein the motorized opening aid is comprised of a drive motor (30) and a gear (31 to 33; 45 to 47; 22) acting on the locking pawl (20);

control means (50 to 52) for activating and deactivating the closing aid and the opening aid;

wherein the drive motor of the closing aid and the drive motor of the opening aid are one and the same common drive motor (30);

wherein the gear of the closing aid has a transmission member (35) switchable between a first switching position and a second switching position;

wherein a drive energy exerted by the common drive motor (30) acts on the transmission member (35) and, as a function of the first and second switching positions of the transmission member (35), acts alternatively downstream of the transmission member (35) via one of two drive paths on the roller catch (11) and the locking pawl (20), respectively; and wherein one of the two drive paths (37 to 39; 53, 54) belongs to the closing aid and the other one of the two drive paths (45 to 47) belongs to the opening aid.

2. The door lock according to claim 1, further comprising:

a switching device (60) connected to the transmission member (35) for switching the transmission member between the first and second switching positions;

wherein the transmission member (35) is configured to be secured by a spring force (44) in the first switching position, wherein in the first switching position the drive energy of the common drive motor (30) is not transmitted to the roller catch (11);

wherein the switching device (60) is configured to be activated at a defined limit angle position of at least one of the roller catch (11) and the locking pawl (20) to transfer the transmission member (35) into the second switching position, wherein in the second switching position the drive energy of the common drive motor (30) acts on the roller catch (11) in a direction of closing of the door of the vehicle; and wherein the switching device (60) is deactivated in a disturbance situation during a pulling shut movement of the door of the vehicle and is deactivated in the main catch position such that the transmission member (35) is automatically returned by the spring force (44) into the first position.

3. The door lock according to claim 2, further comprising one or more sensors (51, 52) configured to detect the pre-catch position of the roller catch (11), wherein the switching device (60) is activated when the pre-catch position of the roller catch (11) is detected by the one or more sensors (51, 52).

4. The door lock according to claim 3, wherein the drive path (37 to 39; 53,54) of the closing aid has an output member (54), wherein, in a last phase of the pulling shut movement (18), a counter force acting on the output member (54) increases; and wherein at least one of a transmission ratio and an efficiency between the output member (54) and the roller catch (11) during the last phase also increases so that a pulling shut force (F1', F2) for closing the door also increases.

5. The door lock according to claim 4, wherein, during the pulling shut movement (18) of the door of the vehicle, the pulling shut force (F1', F2) for closing the door and acting on the roller catch (11) is changed such that the counter force acting on the roller catch (11) is compensated and the common drive motor (30) runs with a substantially constant rpm.

6. The door lock according to claim 5, wherein the output member (54) of the drive path (37) of the closing aid is a lever (54) and wherein the lever (54), starting at the limit angle position, transmits the drive energy of the common motor onto a shoulder (55) of the roller catch (11) and entrains the roller catch (11) against at least one of a restoring force (44) acting on the roller catch and a resistance acting on the door of the vehicle.

7. The door lock according to claim 6, wherein the drive path of the opening aid comprises a rotationally driven control cam (47) and a storage lever (22) loaded by a spring force (25), wherein the control cam (47), directly or indirectly via the storage lever, lifts the pawl (20) out of the pre-catch (16) or out of the main catch (17).

8. The door lock according to claim 7, wherein, after lifting the pawl (20) out of the pre-catch (16) or out of the main catch (17), the roller catch (11) is returned automatically from the pre-catch position or the main-catch position by a restoring force (12) into the open position of the roller catch (11).

9. The door lock according to claim 8, wherein the gears of the closing aid and the opening aid comprise toothed gears, and wherein the common drive motor (30) turns in a rotational direction during the pulling shut movement (18) and in a rotational direction during an opening movement (19) of the door of the vehicle, and wherein the rotational directions of the pulling shut movement and the opening movement are identical.

10. The door lock according to claim 9, wherein the transmission member (35) is comprised of a tumbler wheel having an axle (40), wherein the switching device (60), when moving the transmission member (35) between the first and second switching positions, tilts the axle (40) of the tumbler wheel (25) between two angle positions or pivots the tumbler wheel (25) axis-parallel or moves the tumbler wheel axis-parallel.

11. The door lock according to claim 10, wherein the axle (40) of the tumbler wheel (25) has a first stationary axle end (41), supported in a housing of the door lock and shaped as a ball joint, and a second tiltable axle end (42), rotationally supported on the switching device (60).

12. The door lock according to claim 11, further comprising:

a rotary driven coupling motor (65) acting on the switching device (60) and controlling the switching device (60) for moving the transmission member (35) into the first and second switching positions;

a rocker (61) supporting the second tiltable axle end (42); and a crank guide (69) connected between the rocker (61) and the coupling motor (65), wherein the coupling motor (65) acts via the crank guide (69) on the rocker (61).

13. The door lock according to claim 12, wherein, for opening (19) the door of vehicle, the common drive motor (30) is switched on by actuation of inner, outer, or remote control means and is switched off when the roller catch (11) has reached the defined limit angle position or a defined running time of the common drive motor (30) is exceeded.

14. The door lock according to claim 1, further comprising:

control means for determining positions of a door of the vehicle, the control means having only a first sensor (51) and a second sensor (52) and a control logic (50) connected to the first and second sensors (51, 52);

wherein the first sensor (51) is configured to respond to a certain angle position of the roller catch (11) or a certain relative position of locking part (10) on a door post relative to a locking part on the door of the vehicle;

wherein the second sensor (52) is configured to respond to a drop of the pawl (20) into the pre-catch (16) and into the main catch (17); and wherein the control logic (50) evaluates the individual signals coming from the first and second sensors (51, 52).

15. The door lock according to claim 14, wherein the control logic (50) is configured to detect the open position of the roller catch (11), when the first and second sensors (51, 52) do not respond; to detect the pre-catch position (16), when the first sensor (51) and the second sensor (52) respond; and to detect the main catch position of the roller catch (11), when the second sensor (52) responds and the first sensor (51) does not respond.

16. The door lock according to claim 14, wherein the control logic (50) is configured to detect the open position of the roller catch (11), when the first sensor (51) does not respond and the second sensor (52) responds; to detect the pre-catch position (16), when the first sensor (51) responds and the second sensor (52) does not respond; and to detect the main catch position of the roller catch (11), when the first and second sensors (51, 52) do not respond.

17. The door lock according to claim 14, wherein the control logic (50) is configured to detect the open position of the roller catch (11), when the first and second sensors (51, 52) do not respond; to detect the pre-catch position (16), when the second sensor (52) responds and the first sensor (51) does not respond; and to detect the main catch position of the roller catch (11) when the first and second sensors (51, 52) respond.

18. The door lock according to claim 14, wherein the control logic (50) is configured to detect the open position of the roller catch (11), when the second sensor (52) responds and the first sensor (51) does not respond; to detect the pre-catch position (16), when the first and second sensors (51, 52) do not respond; and to detect the main catch position of the roller catch (11) when the first sensor (51) responds and the second sensor (52) does not respond.

19. The door lock according to claim 2, wherein the switching device (60) is configured to transfer the transmission member (35) into a switched-off position relative to the drive path (37 to 39; 53, 54) of the pulling shut aid.

* * * * *